US005276934A

United States Patent [19]

Brzoska

[11] Patent Number: 5,276,934

[45] Date of Patent: Jan. 11, 1994

[54] DRAIN CLEANING DEVICE

[75] Inventor: Henry G. Brzoska, Stamford, Conn.

[73] Assignee: Lemaks Industries, Inc., Stamford, Conn.

[21] Appl. No.: 823,387

[22] Filed: Jan. 21, 1992

[51] Int. Cl.[5] ..... B08B 9/02

[52] U.S. Cl. ..... 15/104.33; 15/104.18; 15/104.32

[58] Field of Search ..... 15/104.18, 104.19, 104.33, 15/104.31, 104.32, 104.05; 4/255

[56] References Cited

U.S. PATENT DOCUMENTS

| | | | |
|---|---|---|---|
| 1,262,755 | 4/1918 | Cutler | 15/104.31 |
| 1,377,933 | 5/1921 | Sheatsley | 15/104.32 |
| 2,038,170 | 4/1936 | Flavin | 15/104.18 |
| 2,803,026 | 8/1957 | Koffski | 15/104.31 |

FOREIGN PATENT DOCUMENTS

| | | | |
|---|---|---|---|
| 640076 | 12/1936 | Fed. Rep. of Germany | 15/104.33 |
| 12503 | 6/1902 | United Kingdom | 15/104.31 |

*Primary Examiner*—Edward L. Roberts
*Attorney, Agent, or Firm*—Patrick J. Walsh

[57] ABSTRACT

A drain clearing device and method comprising an elongated flexible member for positioning in a blocked drain line with the working end of the tool located beyond the blockage and having means for enlargement or deployment of the working end after the tool is positioned in the drain line so that the blockage in the line is removed by withdrawal of the tool. The method comprises the steps of positioning an enlargable or deployable tool in a drain line beyond the point of blockage, deploying the tool, and withdrawing the deployed tool from the drain line to remove the blockage.

7 Claims, 6 Drawing Sheets

DRAIN CLEANING DEVICE

BACKGROUND OF THE INVENTION

The present invention relates to unplugging clogged toilets and the like and is designated by the proprietary name Toilet Tongue.

A common lavatory problem is the need to unclog plugged toilets. There are many tools and techniques available for this problem and such tools and techniques are generally speaking suitable for accomplishing the task. However, there are specific kinds of toilet plugs that are not cured using known tools and techniques.

For example, a cotton swab known by the trade designation "Q-Tip" comprising a plastic stick two to three inches long with a swab or ball of cotton secured to each end is often discarded in a toilet and can become lodged in the gooseneck portion of the toilet drain. The cotton swab remains lodged in the drain acting as a partial obstruction to normal flushing and eventually becoming a greater obstruction through the gradual buildup of flushed material such as toilet paper and the like. An unclogging tool such as a plumber's helper or a snake may actually unclog the drain by removal of the accumulated debris without disturbing the lodged cotton swab. Consequently, the toilet is returned to service, however, the basic problem remains and the toilet is likely to become plugged again in a relatively short period of time.

The present invention is directed to a device and method particularly suited for unplugging toilets as well as being useful for unplugging other kinds of drains.

SUMMARY OF THE INVENTION

The present invention comprises an elongated flexible tool having an enlargable tip portion for insertion into a toilet or drain to a point beyond a blockage, enlargement of the tip, and removal from the toilet for dislodging the blockage.

One embodiment of the tool comprises an elongated strip or slat approximately 2–6 feet long and fabricated of a flexible material to accommodate bending action as the tool negotiates the course of a toilet drain line. A rigid handle is affixed to the user end of the tool. The working end of the tool includes an inflatable tip which initially conforms to the general contour of the tool and when inflated assumes a generally spherical form occupying substantially the entire cross-sectional area of the drain. By withdrawing the inflated tip into the bowl portion of the toilet, debris ensconsed in the drain line is dislodged with the drain restored to normal usage.

Inflation of the working tip is accomplished by means of a hand bulb secured to the user handle for supplying compressed air to the tip through an interconnecting tube which passes through the elongated strip.

If desired, the tool may be coiled for storage in a convenient place such as a tool kit when not in use.

A second embodiment of the invention comprises an elongated, flexible strip or slat which is capable of bending to negotiate a toilet drain line and is provided with a control spool at the operator end for manipulating the working tip of the tool to incline upwardly or downwardly as the tool enters and negotiates the bends of a toilet drain line and moves into position beyond a blockage. When in position, the tip is erected into a perpendicular section crossing the flexible strip to form a "T"-shaped tool. The erected "T"-shaped tool is then withdrawn from the drain line clearing away the obstruction including the offending cotton swab or similar partial obstruction.

Another embodiment of the invention comprises an elongated flexible strip or slat similar in construction to the first embodiment described above. The working end of this embodiment is equipped with a a pair of spring biased hook members which are retained along the surface of the slat by a slidable sleeve as the tool is inserted into a drain line. When the tool is in position in a drain line the hook members are deployed enlarging the working end of the tool by retracting the slidable sleeve. The hook members are released by the sleeve and their spring bias projects the hooks outwardly from the tool into the drain line flow channel. By withdrawing the tool from the drain, the deployed hooks engage and remove drain line obstructions.

The invention includes a method for clearing blocked toilet drains and the like including the steps of inserting a tool having a collapsed tip into a drain line to a point beyond the block, erecting the tool while deployed in the drain, and withdrawing the erected tip to dislodge the blockage.

OBJECTS OF THE INVENTION

It is an object of the invention to provide a device for clearing plugged toilets and the like.

It is an object of the invention to provide a method for clearing plugged toilets and the like.

It is a further object of the invention to provide a tool for insertion into a drain line past a point of blockage, enlargement of the end of the tool as by inflation, and withdrawal of the enlarged end to clear the blockage.

It is a further object of the invention to provide a tool for insertion into a drain line past a point of blockage, enlargement of the end of the tool as by erection of the end section of the tool into a T-shaped cross piece, and withdrawal of the enlarged end to clear the blockage.

It is a further object of the invention to provide a tool for insertion into a drain line past a point of blockage, enlargement of the end of the tool as by the setup of hook members at the end section of the tool and withdrawal of the enlarged end to clear the blockage.

It is a further object of the invention to provide a drain clearing tool of lightweight, flexible material which can negotiate the turns and bends of a drain line without impairment of its operability.

It is another object of the invention to provide a drain clearing tool which can be coiled into convenient shape for storage when not in use.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the drain cleaning device or toilet tool and is shown in the accompanying drawing in which.

I.

II.

III.

DETAILED DESCRIPTION OF THE INVENTION

Figure 1:
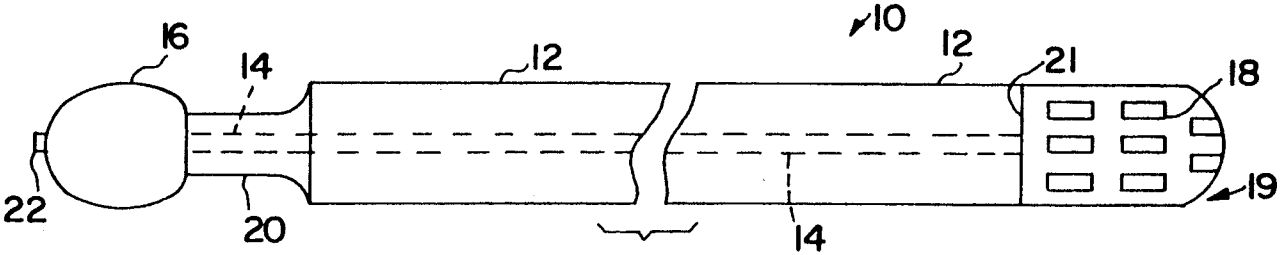
FIG. 1 is a plan view of the toilet tool.
Figure 2:
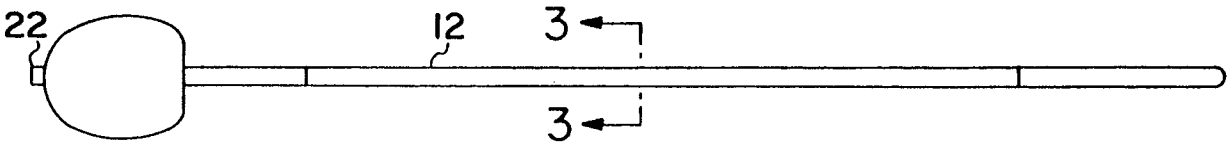
FIG. 2 is a side edge view thereof.
Figure 3:
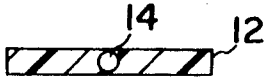
FIG. 3 is a section view taken along line 3—3 of FIG. 2.

Referring now to FIGS. 1-5 of the drawing, a preferred embodiment of the toilet tool 10 comprises an elongated flexible strip or slat 12 formed of suitable material such as polyethylene which will not collapse or kink when bent. The slat may range in length from three to six feet and preferably is four feet long. Its thickness is in a range of one-eight to three-eighths inches and is preferably one-quarter inch thick. The slat encloses an elongated air tube 14 which may be molded in place and extends the full length of the slat providing air communication from an air bulb 16 to an inflatable tip 18 which form part of the toilet tool.

The operator end of the tool includes a rigid handle 20 of suitable material and contour normally gripped by the operator in deploying the tool. As shown in FIG. 1, the air tube 14 extends through the handle to the air bulb. The air bulb 16 is attached to the handle and is of known construction having a hollow rubber casing and valving 22 enabling the operator to deliver compressed air to the inflatable tip via the air tube by repeated squeezes of the air bulb. The air bulb may be used to control balloon inflation after deployment of the tool as by inflation to a greater diameter or deflation to a lesser diameter as determined by actual operating conditions such as variations in drain line diameter, blockage composition and so forth.

The working end of the tool is fitted with a hollow collapsible sack or balloon 18 formed of a relatively thin wall of an abrasion and puncture resistant material such as polyethylene which can be inflated to a diameter of approximately four to six inches in order to occupy the cross-sectional area of a toilet drain line. Balloon 18 covers and is supported by the leading end 19 of slat 12 which occupies the balloon interior in a hand-in-glove fashion. The open end of the balloon is sealed to the slat along seam 21 in an air tight manner. The outer surface 24 of the balloon is fitted with a plurality of barbs 26 which project from the inflated balloon surface in order to snare and remove debris ensconsed in the drain line. Preferably, the barbs are rigid maintaining a planar configuration to lie flat against the collapsed balloon surface, to extend tangentially of the inflated balloon surface, and to aid in dislodging a drain line blockage.

Figure 4:
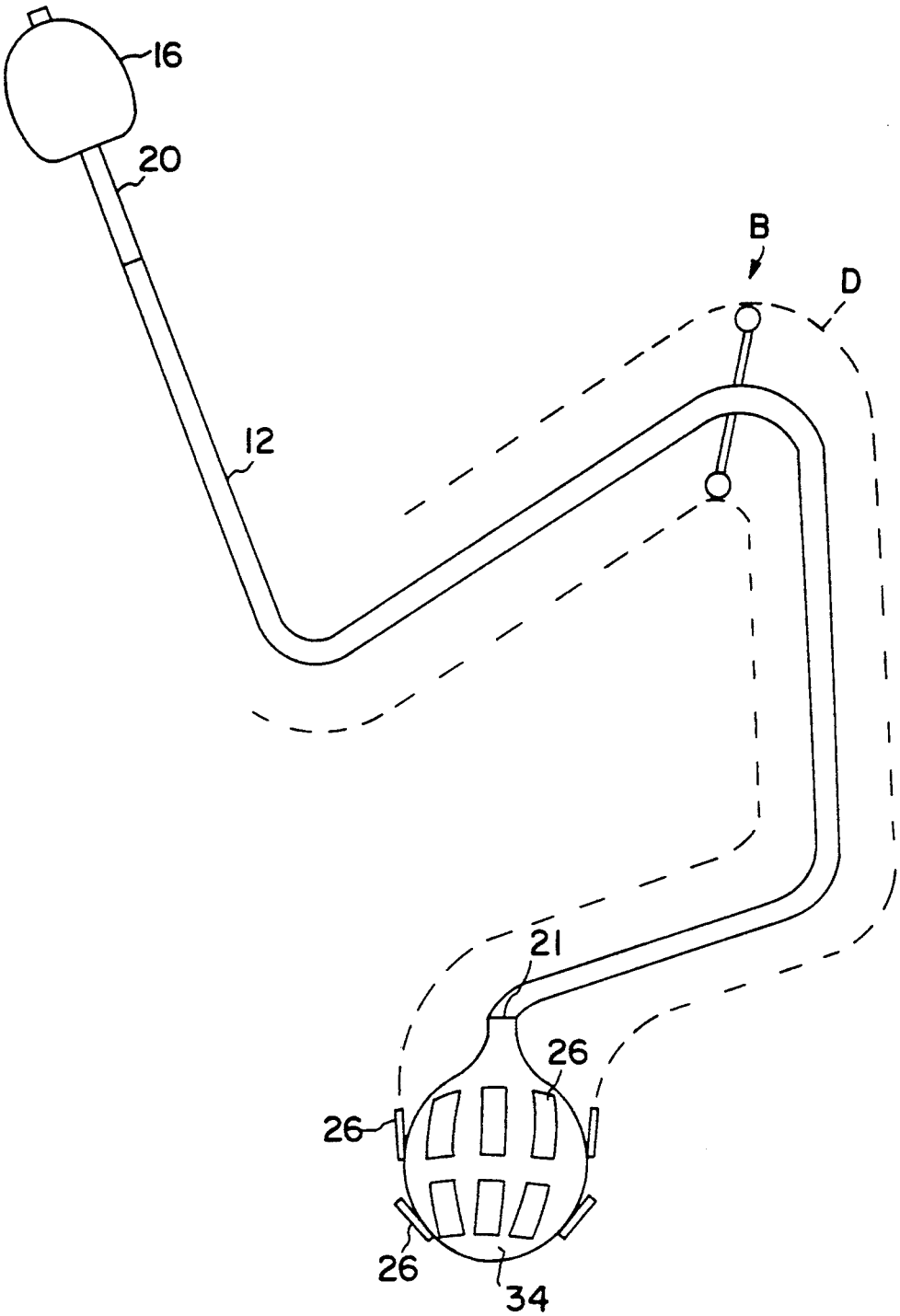
FIG. 4 is a schematic view of deployment of the tool.

Deployment of the tool is shown in FIG. 4 wherein the slat negotiates the sharp bends and turns of a toilet drain D to a point beyond a blockage B. The interior air tube is supported against collapse or kinking by the walls of the slat which have sufficient rigidity to bend along radiuses determined by the contour of the drain line. When in position, the operator inflates the balloon within the constraints of the drain line with the barbs extending tangentially from the balloon surface. By withdrawing the tool, the blockage is dislodged. If the blockage is induced by an article such as a cotton swab lodged in the drain, then the inflated balloon will remove the offending article.

Figure 5:
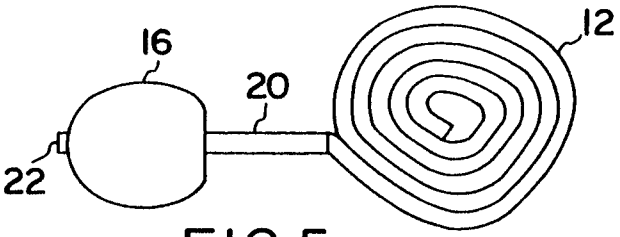
FIG. 5 is a side view of the tool in stored position.

After use, the tool is sanitized as necessary and coiled for storage as shown in FIG. 5.

Another embodiment of the invention shown in FIGS. 6-11 of the drawing comprises a toilet tool 30 of elongated flexible construction approximately 3-6 feet long in which the operating end of the tool is enlarged or deployed by forming a T - shaped tip after the tool has been positioned within the drain line. By withdrawing the deployed tip a drain line blockage is cleared. The tool comprises an elongated sheath 32 open at both ends 34, 36 and having an integral supporting frame 38 extending longitudinally from its operator end 40. The sheath is designed to negotiate the bends and turns of a plumbing drain and is fabricated of flexible material in suitable thickness for this purpose. To facilitate bending, opposite side walls of the sheath are notched 42 defining a plurality of bend lines x—x between notches in the upper 44 and lower 46 walls of the sheath.

Figure 8:
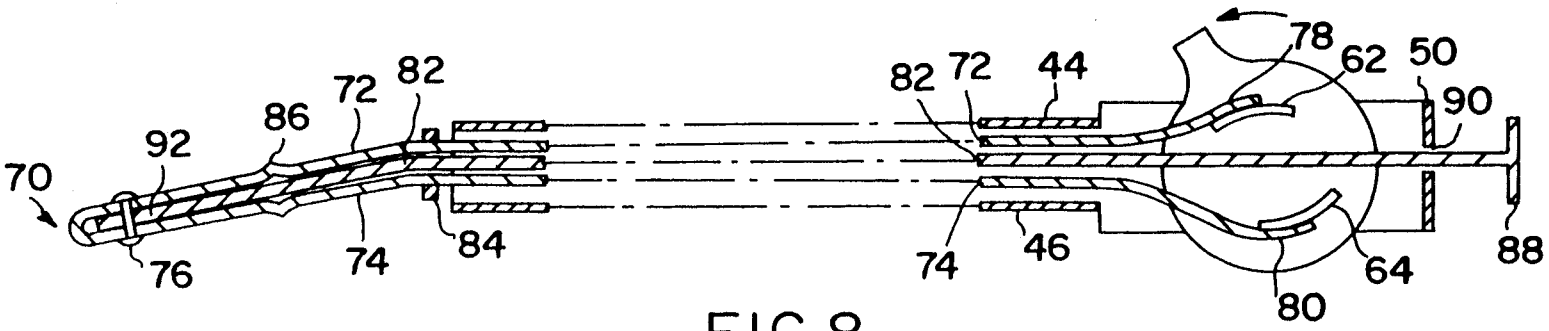
FIG. 8 is a section view corresponding to FIG. 7 showing the tip of the tool inclined downward.
Figure 9:
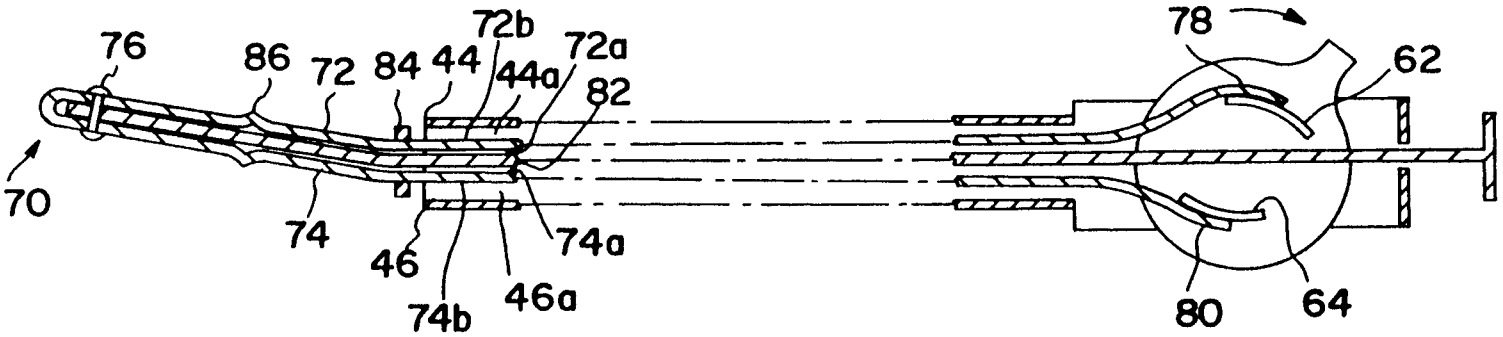
FIG. 9 is a section view corresponding to FIG. 7 showing the tip of the tool inclined upward.

The supporting frame 38 comprises spaced side walls 48 joined by an end wall 50. The frame mounts a control spool 52 by means of stub axles 54 projecting from the spool side walls 56 and received in aligned bores 58 in spaced side walls. The spool includes a segmented hub 60 of upper 62 and lower 64 sections extending between the spool end walls and defining a central passage 66 therebetween. One of the spool end walls is fitted with an upstanding lever 68 to enable the operator to rotate the spool in forward and reverse as shown in FIGS. 8 and 9. Such rotation manipulates to tool tip 70 to incline down or up as shown in these figures and as described more fully below.

Figure 6:
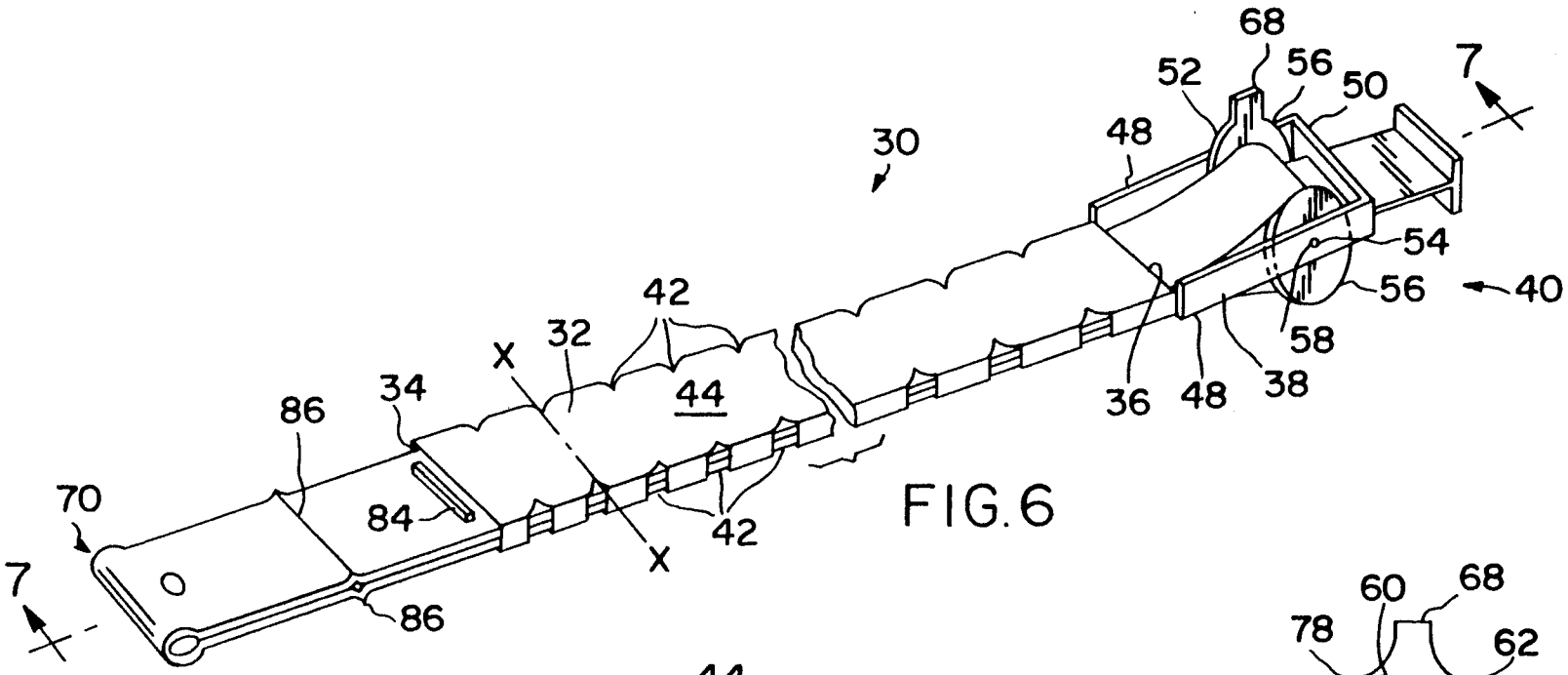
FIG. 6 is a fragmentary perspective view of another embodiment of the invention.
Figure 7:
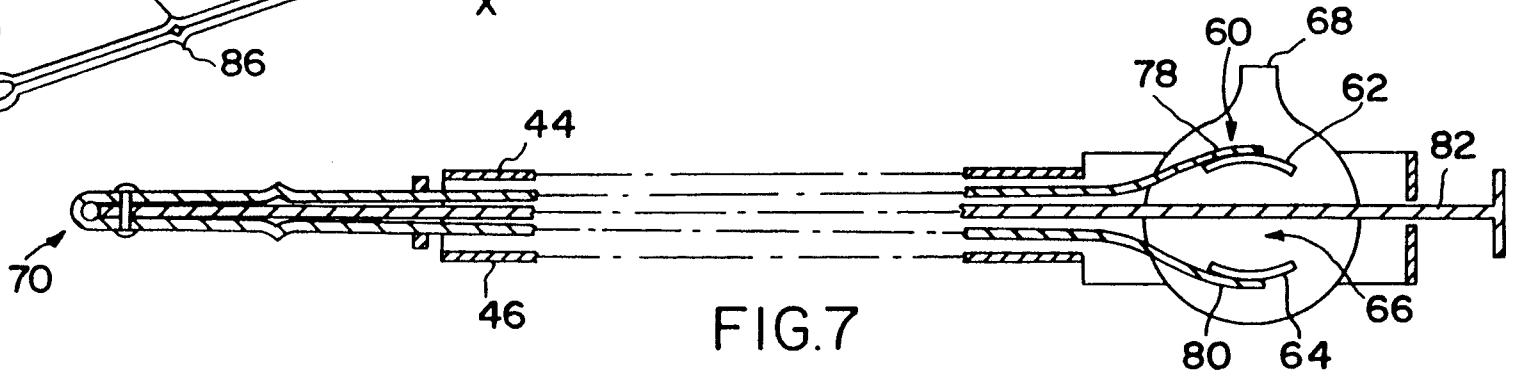
FIG. 7 is a section view taken along line 7—7 of FIG. 6.

The sheath encases upper 72 and lower 74 drain clearing strips of similar construction which extend beyond the working end 34 of the sheath and are joined at one end 70 by a suitable fastener 76 such as a rivet. Preferably, the strips comprise a single length of thin flexible material such as polyethylene which is folded at its midpoint to form the working tip 70. The operator ends 78, 80 of the clearing strips are secured to the segmented hubs 62, 64 of the control spool. When assembled as shown in FIG. 6, the inner facing surfaces 72*a*, 74*a* of the clearing strips 72, 74 are free to slide a short distance along central pull strip 82 to accommodate bending or inclination of the working tip. Similarly, the outer surfaces 72*b*, 74*b* of the strips are also free to slide a short distance with respect to their adjacent sheath surfaces 44*a*, 46*a*. Abutments 84 may be fitted to the upper and lower drain clearing strips near the working end 34 of the sheath in order to limit relative movement with respect the sheath and to promote erection of the clearing strips into a T - shape as more fully described below. Additionally, each clearing strip may be provided with a hinge section 86 extending laterally of the strip as an aid in deploying the strips to a T - shaped configuration.

The central pull strip 82 extends the full length of the tool and projects from the operator end terminating in a pull grip 88. The pull strip is of substantially similar construction and shape as the clearing strips and is of greater length as it extends through the central passage 66 of spool 52 and a slit 90 in the end wall 50 of the supporting frame and terminates a short distance beyond. The working end of the pullstrip is secured to the upper and lower strips by the fastener 76 and is confined along with the clearing strips within the sheath. The pull strip is free to slide along the confronting inner faces 72*a*, 74*a* of the upper and lower clearing strips as necessary to deploy the strip ends into T - shaped configuration.

In operation, the tool is inserted into a toilet drain line. Because of the sharp turns in the drain line, it is useful to incline the leading or working end of the tool in the direction of each bend encountered in the drain line. Accordingly the operator may incline the leading end in a downward direction by rotating the control spool in a forward direction as illustrated in FIG. 8. By rotating the control spool in a forward direction, the upper cleaning strip is moved forward a short distance through the sheath. On the other hand, the lower cleaning strip is withdrawn a short distance determined by extent of spool rotation. Since both cleaning strips are secured together at their leading edges, the net result of spool rotation is to bend or incline the leading edge of the cleaning strips downwardly. Similarly, the leading edge may be inclined upwardly as shown in FIG. 9 by rotating the control spool to the rear of the tool.

As the tool progresses into the drain, the central portion of the tool defined by the sheath will also bend as it engages and is constrained by the interior surface of the drain line. As noted the sheath is notched along its side edges to allow for ease of bending in order to negotiate the sharp bends of a toilet drain.

Figure 10:
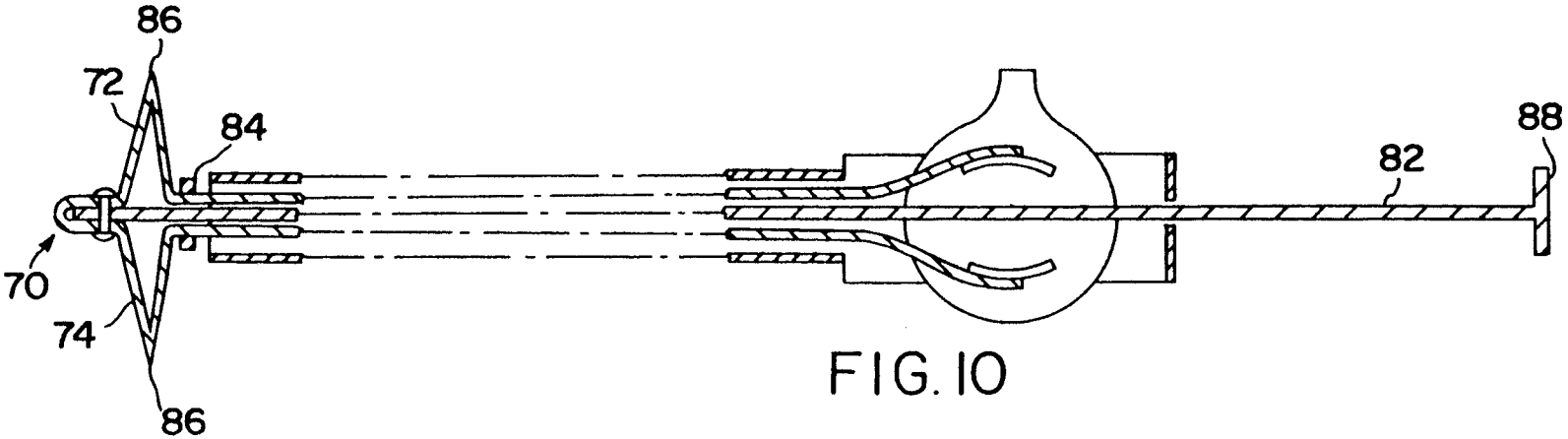
FIG. 10 is a section view corresponding to FIG. 7 showing the tip of the tool deployed.
Figure 11:
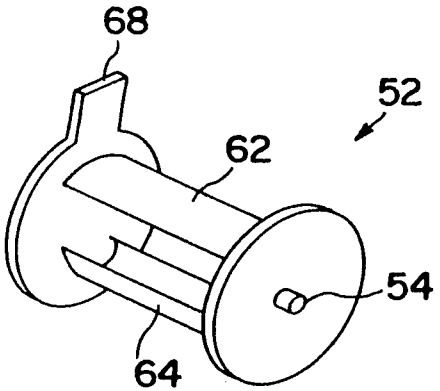
FIG. 11 is a perspective view of the control spool for manipulating the tool.

When the operator judges that the tool has passed the point of blockage, he will then deploy or enlarge the working end of the tool by erecting the ends of the cleaning strips as shown in FIG. 10. Such deployment is accomplished be pulling the control strip to the rear. The abutments restrict rearward movement of the cleaning strips into the sheath. The control strip is free to move the length of its normal excursion as the tips are deployed to a T-shape shown in FIG. 10. Therefore the cleaning strips will fold along their hinges and remain in upright deployment for so long as the control strip remains in the rear position shown in FIG. 10.

With the cleaning strips in T-shaped position, the operator then withdraws the tool through the drain line thereby clearing the drain line blockage. When the blockage is cleared, the pull strip is moved forward collapsing the cleaning strips returning the tool to its original position for sanitizing and reuse.

Figure 12:
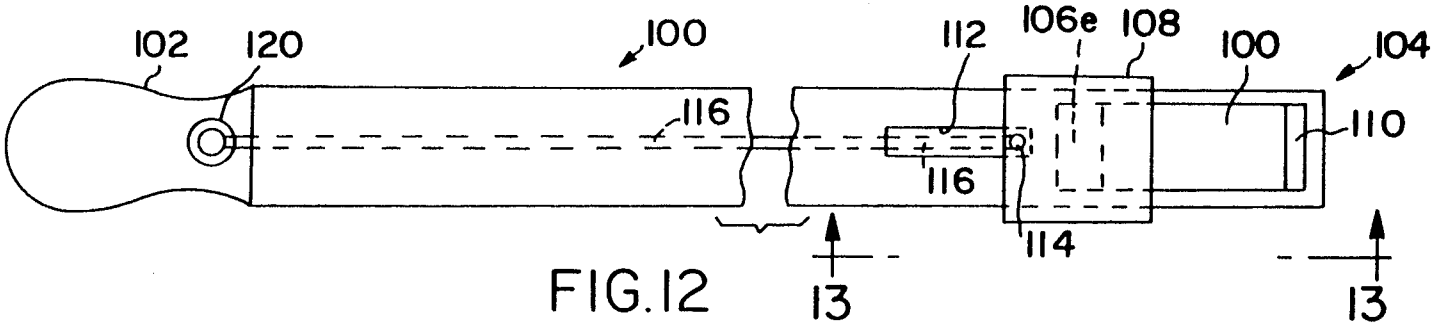
FIG. 12 is a fragmentary perspective view of another embodiment of the invention.
Figure 13:
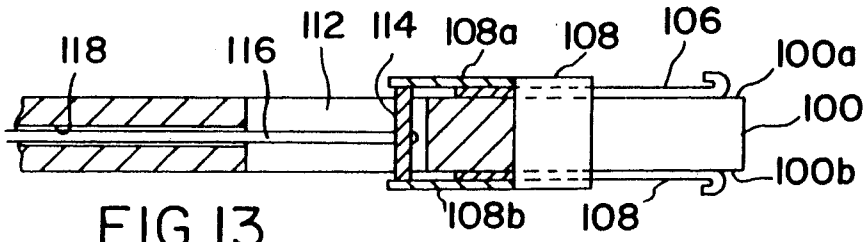
FIG. 13 is an enlarged fragmentary section view taken along line 13—13 of FIG. 12.
Figure 14:
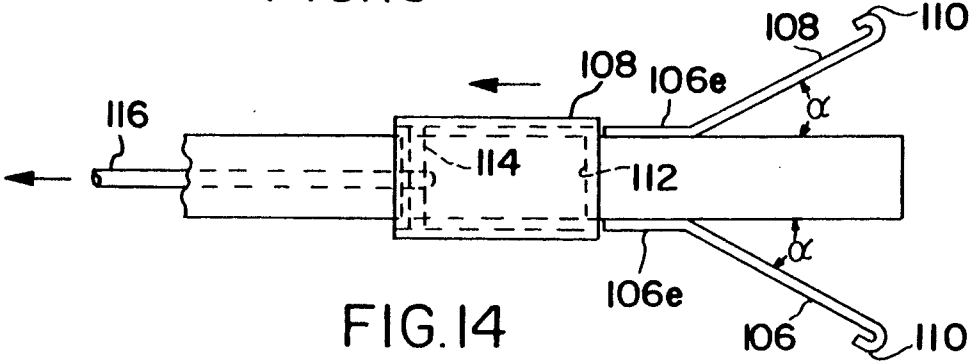
FIG. 14 is an enlarged fragmentary edge view showing deployment of the tool of FIG. 12.

Another embodiment of the invention is shown in FIGS. 12–14. This form includes an elongated slat 100 of similar shape and construction as the slat of FIGS. 1–5 fitted with a suitable handle 102 at the operator end. The working end 104 is provided with preferably two spring hooks 106 which are normally retained in a first collapsed position against the upper and lower slat surfaces 100*a–b* by means of a slidable sleeve 108. The springs are fabricated of spring steel or other suitable material capable of maintaining a spring set. Each spring hook is approximately as wide as the slat and is secured to the slat by spring anchor panel 106*e*. The spring hooks form part of the working tip of the tool with each hook projecting at a diverging angle alpha from the slat surface. The free end of each spring is reversed in the form of a hook 110 for grabbing and dislodging waste material located in a drain line.

The moveable sleeve 108 conforms closely to the outer contour of the slat and is sufficiently rigid to encompass and force the spring hooks into the first stored or collapsed position as shown in FIG. 13. The excursionary path of the slidable sleeve is determined by a slot 112 incised in the slat and having a length approximately equal to that of the sleeve. A vertical bar 114 connects the upper 108*a* and lower 108*b* panels of the sleeve and extends through the slot. The bar limits sleeve movement along the slat, retains the sleeve on the slat, and receives a pull cable 116 enabling the operator to withdraw the sleeve and deploy the spring hooks to a second or enlarged configuration shown in FIG. 14. The pull cable extends through a central passage 118 in the slat terminating in a pullring 120 near the handle.

In operation, the tool is inserted into a drain line a sufficient distance such that the working tip is positioned beyond a line blockage with the spring hooks in a first or collapsed position under restraint of the slidable sleeve. The operator next retracts the sleeve releasing the springs to deployed position of FIG. 14. By withdrawing the tool the blockage is snagged by the hooks and removed.

In the foregoing description the tool has been described in use for clearing toilet blockages, however, it will be understood that the tool is one of general application for clearing blocked drains of various kinds.

I claim:

1. A drain clearing tool comprising an elongate member of flexible construction having a working end and an operator end, the member having a sheath encasing a pair of cooperating clearing clearing strips and a control strip, the elongate member being capable of negotating the bends of a drain line, the clearing strips terminating in a working end for positioning in a drain line beyond the point of blockage, the working end having a first normally collapsed configuration in which the tool is brought into operating position in the drain line and a second T-shaped configuration for engaging and clearing a blockage, the control strip enabling the tool operator to deploy the end from first to second configuration while end tip is positioned beyond the point of blockage so that the drain may be cleared by withdrawing the tool from the drain line.

2. A drain clearing tool as defined in claim 1 in which the working ends of the clearing strips and the control strip are secured together and which further includes a control spool affixed to the operator end of the elongate member and securing the operator ends of the clearing strips so that by rotating the spool in forward and reverse directions the working tips of the clearing strips may be inclined downwardly and upwardly, respectively, as a aid in negotiating the bends of a drain line.

3. A drain clearing tool as defined in claim 2 in which the control strip extends past the control spool and is pulled by the operator in deploying the working end of the tool.

4. A drain clearing tool as defined in claim 3 which further includes a supporting frame for mounting the control spool at the operator end of the tool.

5. A drain clearing tool as defined in claim 1 in which the sides of the sheath are notched to facilitate bending of the sheath as it negotates a drain line.

6. A drain clearing tool as defined in claim 1 in which the working ends of the clearing strips are fitted with transverse hinges and abutments limiting rearward movement in order to facilitate deployment of the strips from first to second configuration.

7. A drain clearing tool comprising an elongate member of flexible construction having a working end and an operator end, the member having a pair of cooperating clearing strips and a control strip and being capable of negotiating the bends of a drain line, the clearing strips terminating in a working end having a tip for positioning in a drain line beyond the point of blockage, the working end tip having a first normally collapsed configuration in which the tool is brought into operating position in the drain line and a second enlarged configuration in which the clearing strips working end tip forms a T-shape with the elongate member for engaging and clearing a blockage, the control strip being positioned between the clearing strips and affixed to their working end, the control strip further extending to the operator end for enabling the tool operator to deploy the working end tip from first to second configuration while the tip is positioned beyond the point of blockage so that the drain may be cleared by withdrawing the tool from the drain line.

* * * * *